US011114776B2

(12) United States Patent
Van'tZelfde

(10) Patent No.: US 11,114,776 B2
(45) Date of Patent: Sep. 7, 2021

(54) METHOD FOR CONNECTING CONDUCTIVE FABRIC TO WIRE

(71) Applicant: JOYSON SAFETY SYSTEMS ACQUISITION LLC, Auburn Hills, MI (US)

(72) Inventor: Dwayne Van'tZelfde, Holly, MI (US)

(73) Assignee: JOYSON SAFETY SYSTEMS ACQUISITION LLC, Auburn Hills, MI (US)

( * ) Notice: Subject to any disclaimer, the term of this patent is extended or adjusted under 35 U.S.C. 154(b) by 79 days.

(21) Appl. No.: 16/717,011

(22) Filed: Dec. 17, 2019

(65) Prior Publication Data

US 2020/0220280 A1 Jul. 9, 2020

Related U.S. Application Data

(60) Provisional application No. 62/790,302, filed on Jan. 9, 2019.

(51) Int. Cl.

| | |
|---|---|
| ***H01R 4/62*** | (2006.01) |
| ***H01R 4/28*** | (2006.01) |
| ***H01R 4/72*** | (2006.01) |

(52) U.S. Cl.

CPC ..... *H01R 4/62* (2013.01); *H01R 4/28* (2013.01); *H01R 4/726* (2013.01)

(58) Field of Classification Search

CPC ..... H01R 4/28; H01R 4/62; H01R 4/726

See application file for complete search history.

(56) References Cited

U.S. PATENT DOCUMENTS 3,414,666 A * 12/1968 Doundoulakis ..... H01B 13/012 174/261
4,865,038 A * 9/1989 Rich ..... A61B 5/14552 600/344

(Continued)

FOREIGN PATENT DOCUMENTS

CN 207209497 U 4/2018
JP 2006292631 A * 10/2006

(Continued)

OTHER PUBLICATIONS

International Search Report and Written Opinion in connection to International Application No. PCT/US2019/066773, dated Apr. 16, 2020.

*Primary Examiner* — Carl J Arbes

(74) *Attorney, Agent, or Firm* — Meunier Carlin & Curfman LLC

(57) ABSTRACT

Various implementations include a method of connecting wire to conductive fabric. The method includes (1) providing a conductive fabric having a main portion and a protrusion extending along a protrusion central axis from the main portion, the protrusion having a distal edge spaced apart from the main portion along the central axis and side edges that extend between the main portion and the distal edge; (2) placing a wire along at least a portion of the protrusion, the wire having a first end and a second end opposite the first end; (3) folding the distal edge of the protrusion over the wire one or more times to form a folded portion of the protrusion; and (4) after folding the distal edge, securing the folded portion of the protrusion with a securing device.

20 Claims, 5 Drawing Sheets

(56) References Cited

U.S. PATENT DOCUMENTS

| | | | | | |
|---|---|---|---|---|---|
| 5,090,410 | A | * | 2/1992 | Saper | A61B 1/00142 356/41 |
| 5,906,004 | A | * | 5/1999 | Lebby | A41D 31/00 2/1 |
| 6,026,512 | A | * | 2/2000 | Banks | A43B 7/36 2/69 |
| 6,080,690 | A | * | 6/2000 | Lebby | D03D 15/258 442/209 |
| 10,056,702 | B2 | | 8/2018 | de la Garza Fernandez et al. | |
| 2005/0095406 | A1 | | 5/2005 | Gunzel et al. | |

FOREIGN PATENT DOCUMENTS

| | | | | |
|---|---|---|---|---|
| JP | 2010250980 | A | * | 11/2010 |
| WO | 97/42903 | | * | 11/1997 |
| WO | 2001036728 | A1 | * | 5/2001 |

* cited by examiner

METHOD FOR CONNECTING CONDUCTIVE FABRIC TO WIRE

BACKGROUND

Multiple methods for creating an electrical connection between two materials exist. Many of these methods include connecting two malleable materials (e.g., two metal wires) by crimping the two materials together. This method ensures both secure mechanical and secure electrical connections between the two materials.

However, for non-malleable materials, crimping methods do not work. Materials such as conductive fabric are manufactured from non-malleable, knitted mesh fabric which cannot be crimped. Often, physical methods, such as crimping, rip or tear the conductive fabric, causing both the mechanical and the electrical connections to fail.

Without other means for ensuring a sufficient mechanical connection, the wire is susceptible to external strain that could cause the wire to become physically disconnected. For example, simply holding the wire against the conductive fabric with a connector does not ensure a secure electrical connection between the wire and the conductive fabric when external strain is introduced.

Thus, there is a need for a method of connecting conductive fabric to a wire such that a secure electrical connection is made between the conductive fabric and the wire without damaging the conductive fabric.

SUMMARY

Various implementations include a method of connecting wire to conductive fabric. The method includes (1) providing a conductive fabric having a main portion and a protrusion extending along a protrusion central axis from the main portion, the protrusion having a distal edge spaced apart from the main portion along the protrusion central axis and side edges that extend between the main portion and the distal edge; (2) placing a wire along at least a portion of the protrusion, the wire having a first end and a second end opposite the first end; (3) folding the distal edge of the protrusion over the wire one or more times to form a folded portion of the protrusion; and (4) after folding the distal edge, securing the folded portion of the protrusion with a securing device.

In some implementations, the securing device is one of a tie, a heat shrink material, or both.

In some implementations, the wire is placed along at least a portion of the protrusion such that a first end of the wire is adjacent the distal edge of the protrusion.

In some implementations, the method further includes rotating the folded portion of the protrusion 90° after folding the distal edge.

In some implementations, the method further includes, after placing the wire along at least a portion of the protrusion, bending the wire to form a first wire bend, the wire having a first portion that extends between the first end to the first wire bend. The protrusion has a first surface and a second surface. The first portion is disposed adjacent the first surface of the protrusion, another portion of the wire is adjacent the second surface of the protrusion, and the first portion is disposed transverse to the protrusion central axis. In some implementations, bending the wire to form the first wire bend occurs after folding the distal edge of the protrusion over the wire.

In some implementations, the method further includes, before placing the wire along at least a portion of the protrusion, bending the wire to form a first wire bend, the wire having a first portion that extends between the first end to the first wire bend. The protrusion has a first surface and a second surface. The first portion is disposed adjacent the first surface of the protrusion, another portion of the wire is adjacent the second surface of the protrusion, and the first portion is disposed transverse to the protrusion central axis.

In some implementations, the method further includes, after folding the distal edge, bending the wire to form a second wire bend, the wire having a second portion that extends from the second wire bend to the second end.

In some implementations, the method further includes folding the side edges of the protrusion toward each other prior to folding the distal edge of the protrusion.

In some implementations, the method further includes folding the side edges of the protrusion toward each other prior to securing the folded portion of the protrusion with the securing device.

In some implementations, the wire extends along an axis that is between 0° and 45° relative to the protrusion central axis prior to folding the distal edge of the protrusion, and the wire is folded with the protrusion during the folding of the distal edge of the protrusion. In some implementations, the method further includes, after folding the distal edge and the wire, bending the wire to form a first wire bend. The securing device secures the folded portion and at least a portion of the wire between the first wire bend and the second end. In some implementations, the method further includes folding the side edges of the protrusion toward each other prior to securing the folded portion of the protrusion with the securing device. In some implementations, the method further includes folding the side edges of the protrusion toward each other prior to placing the wire along at least a portion of the protrusion.

In some implementations, the conductive fabric includes silver plated, knitted nylon mesh.

In some implementations, the tie is a metal terminal splice, a ferrule, a zip tie, a string, tape, or an overstitch.

In some implementations, the heat shrink material has a shrink ratio of X:1, and X is 2 or greater.

In some implementations, the heat shrink material has an inside surface and includes an adhesive liner disposed on the inside surface.

In some implementations, the heat shrink material is single wall heat shrink material.

In some implementations, the heat shrink material is double wall heat shrink material.

BRIEF DESCRIPTION OF DRAWINGS

Example features and implementations are disclosed in the accompanying drawings. However, the present disclosure is not limited to the precise arrangements and instrumentalities shown. Similar elements in different implementations are designated using the same reference numerals.

DETAILED DESCRIPTION

Various implementations include a method of connecting wire to conductive fabric. The method includes (1) providing a conductive fabric having a main portion and a protrusion extending along a protrusion central axis from the main portion, the protrusion having a distal edge spaced apart from the main portion along the protrusion central axis and side edges that extend between the main portion and the distal edge; (2) placing a wire along at least a portion of the protrusion, the wire having a first end and a second end opposite the first end; (3) folding the distal edge of the protrusion over the wire one or more times to form a folded portion of the protrusion; and (4) after folding the distal edge, securing the folded portion of the protrusion with a securing device.

Figures 1A, 1B, 1C:
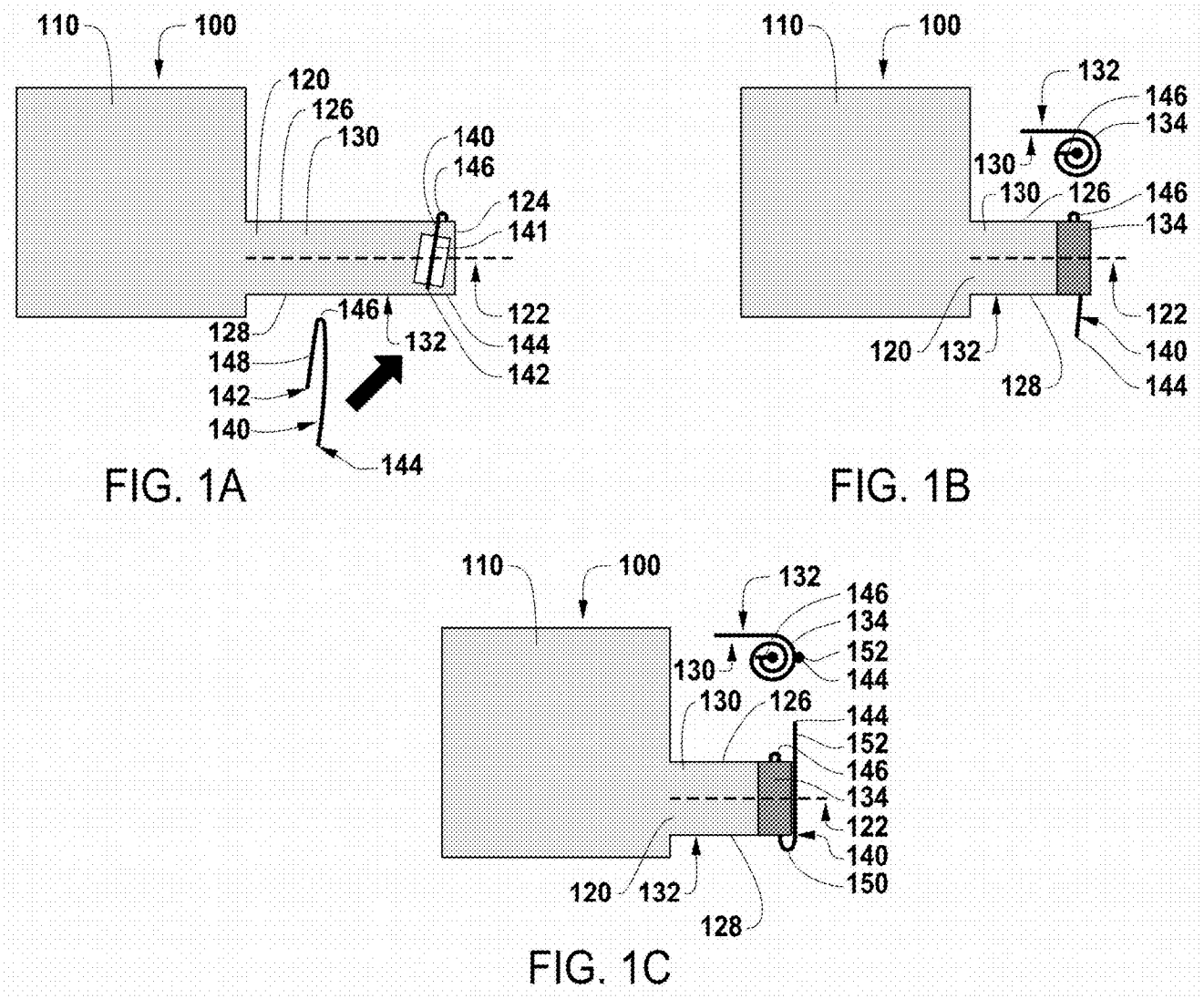
FIGS. 1A-1G are top views showing a method of connecting wire to conductive fabric, in accordance with one implementation.

FIGS. 1A-1G show one implementation of a method of connecting wire 140 to conductive fabric 100. FIGS. 1A-1G show a conductive fabric 100 and a wire 140. The conductive fabric 100 has a main portion 110 and a protrusion 120 extending along a protrusion central axis 122 from the main portion 110. The protrusion 120 has a distal edge 124 spaced apart from the main portion 110 along the protrusion central axis 122. The protrusion 120 also has side edges 126, 128 that extend between the main portion 110 and the distal edge 124. The protrusion 120 further has a first surface 130 and a second surface 132 opposite the first surface 130. The conductive fabric 100 shown in FIG. 1A is a silver plated, knitted nylon mesh. However, in other implementations, the conductive fabric may be any thin, flexible, and conductive material capable of being folded with a wire such that the wire makes secure electrical and mechanical contact with the conductive fabric.

The wire 140 has a first end 142 and a second end 144 opposite the first end 142. The wire 140 is a multi-stranded tin-plated copper wire that is devoid of insulation on the portions of the wire 140 that contact the conductive fabric 100, as discussed below. However, in other implementations, the wire may be any material and construction of wire capable of conducting a current from the first end of the wire to the second end of the wire, such as silver-plated wire or corrosion resistant stranded wire.

FIG. 1A shows a first step of bending the wire 140 to form a first wire bend 146. A first portion 148 of the wire 140 extends between the first end 142 to the first wire bend 146. The wire 140 is placed along at least a portion of the protrusion 120 such that a first end 142 of the wire 140 is adjacent the distal edge 124 of the protrusion 120. The first portion 148 of the wire 140 is disposed adjacent the first surface 130 of the protrusion 120, and another portion of the wire 140 is adjacent the second surface 132 of the protrusion 120. The wire 140 is positioned relative to the protrusion 120 such that the first portion 148 extends transverse to the protrusion central axis 122. The wire 140 is held in place by an isotropic conductive pressure-sensitive adhesive 141 ("PSA"). The PSA 141 holds the wire 140 and the folded portion 134, as discussed below, in place and still allows electrical conductivity between the wire 140 and protrusion 120 through the PSA 141. However, in other implementations, the wire is held in place by any other conductive adhesive such that the wire is secured to the protrusion, and the folded portion is secured after folding, and the wire and protrusion are still in electrical communication. In some implementations, the wire 140 is not the wire is secured to the protrusion by an adhesive. In these implementations, the wire can be secured to the protrusion manually (e.g., by hand).

FIG. 1B shows a second step of folding the distal edge 124 of the protrusion 120 over the wire 140 three times to form a folded portion 134 of the protrusion 120. Although FIG. 1B shows the distal edge 124 of the protrusion 120 folded over the wire 140 three times, in other implementations, the distal edge of the protrusion is folded over the wire one or more times. "Folding" as used herein refers to bending, turning, or rolling the conductive fabric over on itself so that one part of the conductive fabric covers another part of the fabric. The resulting shape of the folded portion of the fabric can be flattened or cylindrical.

The wire 140 in FIG. 1A is bent to form a first wire bend 146 prior to placing the wire 140 along at least a portion of the protrusion 120. However, in other implementations, the wire is placed along at least a portion of the protrusion first and then the wire is bent to form the first wire bend prior to folding the distal edge of the protrusion over the wire. In other implementations, the distal edge of the protrusion is folded over the wire prior to bending the wire to form the first wire bend. In these implementations, the wire has a first portion as discussed above with respect to FIG. 1A. When the wire is bent, the first portion is disposed adjacent the first surface of the protrusion, and another portion of the wire is adjacent the second surface of the protrusion. As discussed above with respect to FIG. 1A, the first portion is disposed transverse to the protrusion central axis.

FIG. 1C shows a third step of bending the wire 140 to form a second wire bend 150. A second portion 152 of the wire 140 extends from the second wire bend 150 to the second end 144 of the wire 140. After the wire 140 is bent to form a second wire bend 150, the second portion 152 of the wire 140 is disposed adjacent the second surface 132 of the protrusion 120.

Figure 1E:
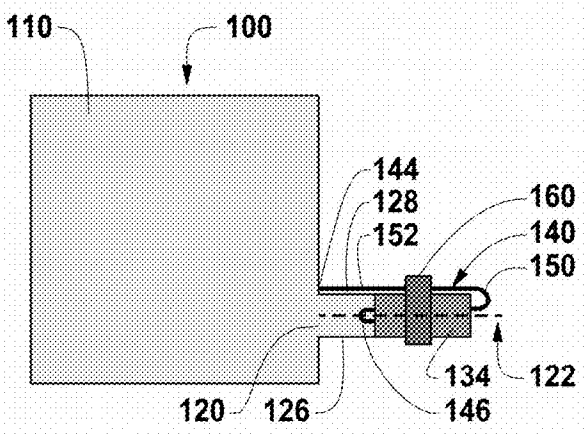
Figure 1D:
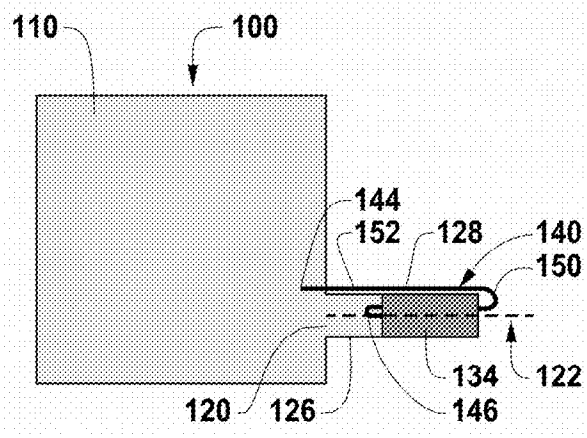

FIG. 1D shows a fourth step of rotating the folded portion 134 of the protrusion 120 ninety degrees. After the folded portion 134 of the protrusion 120 has been rotated, the second portion 152 of the wire 140 extends parallel with the protrusion central axis 122. The wire 140 shown in FIG. 1D is oriented such that the second portion 152 of the wire 140 extends from the second wire bend 150 toward the main portion 110 of the conductive fabric 100. However, in other implementations, the wire is oriented such that the second portion of the wire extends from the second wire bend away from the main portion of the conductive fabric.

FIG. 1E shows a fifth step of securing the folded portion 134 of the protrusion 120 with a first securing device 160. The first securing device 160 shown in FIG. 1E is a tie (e.g., a zip tie). However, in other implementations, the securing device may be a metal terminal splice, a ferrule, a string, tape, an overstitch, heat shrink material, low-pressure overmold, an adhesive, hot glue, epoxy, UV cured epoxy, or any other securing device capable of applying enough pressure to prevent the folded portion of the protrusion from unfolding and to ensure contact between the wire and the conductive fabric without damaging the conductive fabric.

Figure 1G:
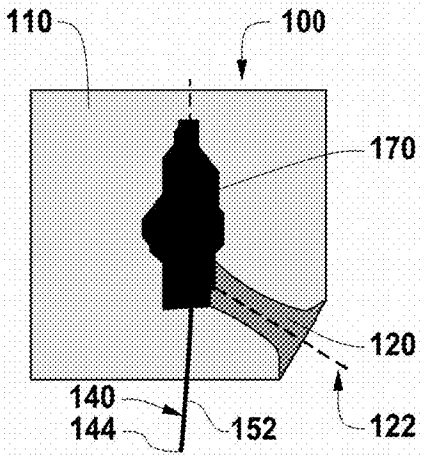
Figure 1F:
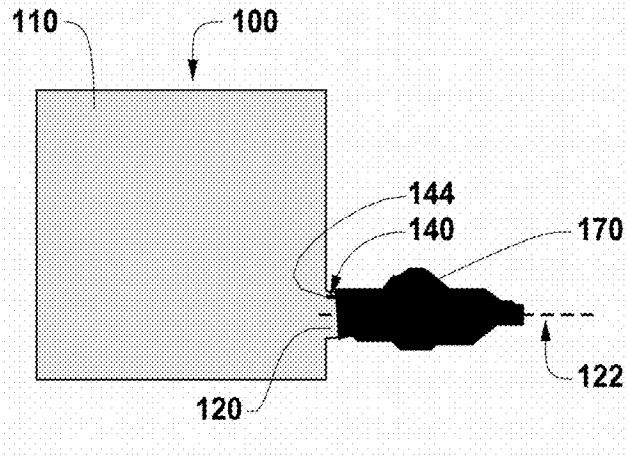

FIG. 1F shows a sixth step of securing the folded portion 134 of the protrusion 120 and the first securing device 160 with a second securing device 170. The securing device shown in FIG. 1F is a heat shrink material having a shrink ratio of 4:1 such that, when the heat shrink material is heated, it decreases ("recovers") to a quarter of its size. The heat shrink material shown in FIG. 1F is a single wall heat shrink material. The heat shrink material includes an adhesive lining on the inside of the heat shrink material. However, in other implementations, the heat shrink material has a shrink ratio of X:1, and X is 2 or greater. And, in other implementations, the heat shrink material may be a double wall heat shrink material. Furthermore, in other implementations, the second securing device may include any other securing device discussed above with respect to the first securing device 160 in FIG. 1E.

FIGS. 1E and 1F show the securing of the folded portion 134 of the protrusion 120 with a securing device 160, 170. However, in other implementations, the method includes securing the folded portion of the protrusion with only one securing device, or more than two securing devices.

FIG. 1G shows a seventh step of folding the protrusion 120 such that the folded portion 134 is adjacent the main portion 110 of the conductive fabric 100. The folded portion 134 of the protrusion 120 is then secured to the main portion 110 of the conductive fabric 100 to relieve any strain that may otherwise be applied to the protrusion 120 and/or wire 140. The protrusion 120 of the conductive fabric 100 shown in FIG. 1G is secured to the main portion 110 by hot glue. However, in other implementations, the protrusion is secured to the main portion by other adhesives, such as PSA adhesive or any other adhesive capable of securing the protrusion to the main portion and relieving strain applied to the protrusion and/or wire. In some implementations, the protrusion is not secured to the main portion.

FIGS. 2A-2D show another implementation of a method of connecting wire 140 to conductive fabric 100. The conductive fabric 100 and wire 140 shown in FIGS. 2A-2D are the same conductive fabric 100 and wire 140 as used in the implementation shown in FIGS. 1A-1G.

Figure 2B:
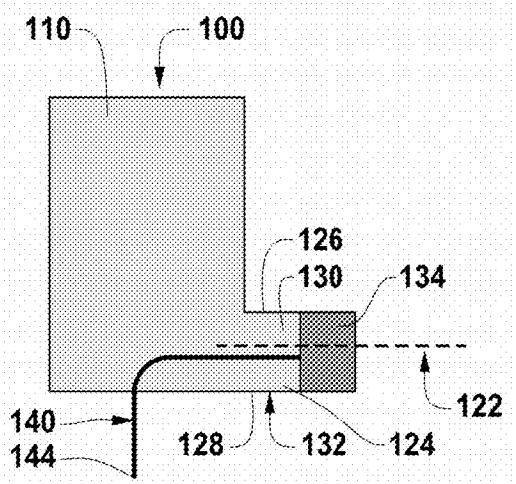
FIGS. 2A-2D are top views showing a method of connecting wire to conductive fabric, in accordance with another implementation.
Figure 2A:
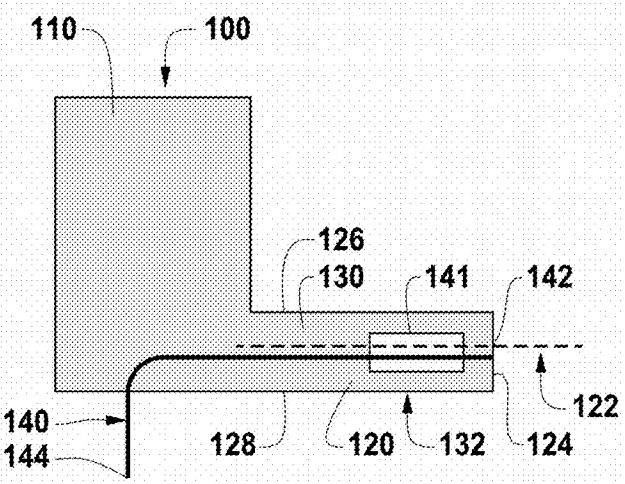

FIG. 2A shows a first step of placing the wire 140 along a portion of the protrusion 120 such that the first end 142 of the wire 140 is adjacent the distal edge 124 of the protrusion 120 and the wire 140 is disposed adjacent the first surface 130 of the protrusion 120. The wire 140 is positioned relative to the protrusion 120 such that the wire 140 extends parallel to the protrusion central axis 122. The wire 140 is held in place by an isotropic conductive PSA 141. The PSA 141 holds the wire 140 and the folded portion 134, as discussed below, in place and still allows electrical conductivity between the wire 140 and protrusion 120 through the PSA 141. However, in other implementations, the wire is held in place by any other conductive adhesive such that the wire is secured to the protrusion, and the folded portion is secured after folding, and the wire and protrusion are still in electrical communication.

FIG. 2B shows a second step of folding the distal edge 124 of the protrusion 120 over the wire 140 three times to form a folded portion 134 of the protrusion 120. Because the wire 140 extends parallel to the protrusion central axis 122, the wire 140 is folded with the protrusion 120 during the folding of the distal edge 124 of the protrusion 120. FIG. 2B shows the distal edge 124 of the protrusion 120 folded over the wire 140 three times. However, in other implementations, the distal edge of the protrusion is folded over the wire one or more times.

Figure 2D:
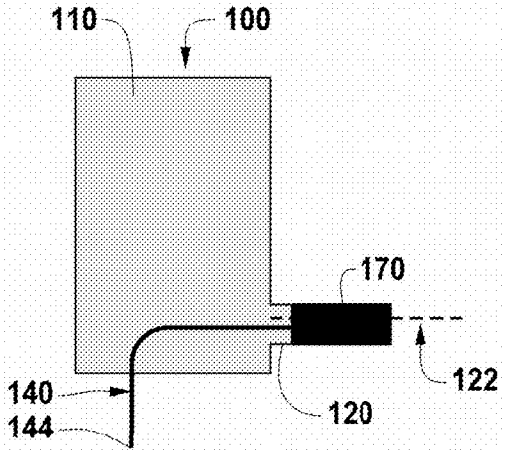
Figure 2C:
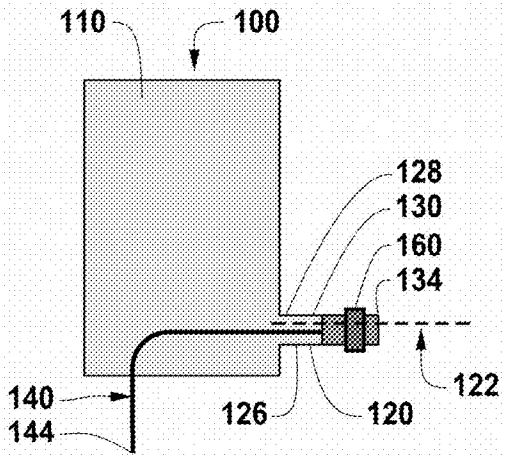

FIG. 2C shows a third step of folding the side edges 126, 128 of the protrusion 120 toward each other to decrease the width or effective diameter of the folded portion 134 and protrusion 120 as measured perpendicular to the protrusion central axis 122. FIG. 2C shows folding the side edges 126, 128 of the protrusion 120 toward each other after folding the distal edge 124 of the protrusion 120 over the wire 140. However, in other implementations, the side edges of the protrusion are folded toward each other prior to folding the distal edge of the protrusion over the wire and/or prior to placing the wire along the protrusion.

FIG. 2C also shows securing the folded portion 134 of the protrusion 120 with a first securing device 160. The securing device shown in FIG. 2C is a tie (e.g., a zip tie). However, in other implementations, the first securing device can be any of the other securing devices discussed above with respect to FIG. 1E. In other implementations, the side edges of the protrusion are folded toward each other prior to securing the folded portion of the protrusion with the first securing device.

FIG. 2D shows a fourth step of securing the folded portion 134 of the protrusion 120 and the first securing device 160 with a second securing device 170. The second securing device 170 shown in FIG. 2D is a heat shrink material having a shrink ratio of 4:1 such that, when the heat shrink material is heated, it decreases ("recovers") to a quarter of its size. The heat shrink material shown in FIG. 2D is a single wall heat shrink material. The heat shrink material includes an adhesive lining on the inside of the heat shrink material. However, in other implementations, the heat shrink material may have a shrink ratio of X:1, and X is 2 or greater. And, in other implementations, the heat shrink material may be a double wall heat shrink material. Furthermore, in other implementations, the second securing device may be any other securing device discussed above with respect to the first securing device 160 in FIG. 1E.

FIGS. 2C and 2D show the securing of the folded portion 134 of the protrusion 120 with a securing device 160, 170. However, in other implementations, the method includes securing the folded portion of the protrusion with only one securing device, or more than two securing devices.

FIGS. 3A-3D show another implementation of a method of connecting wire 140 to conductive fabric 100. The conductive fabric 100 and wire 140 shown in FIGS. 3A-3D are the same conductive fabric 100 and wire 140 as used in the implementation shown in FIGS. 1A-1G and 2A-2D.

Figure 3B:
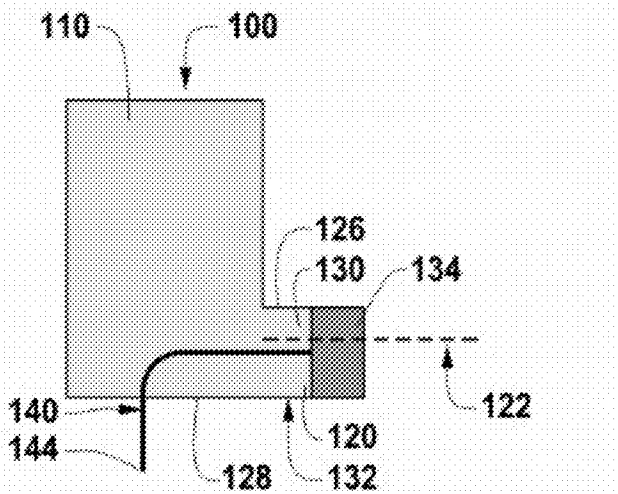
FIGS. 3A-3D are top views showing a method of connecting wire to conductive fabric, in accordance with another implementation.
Figure 3A:
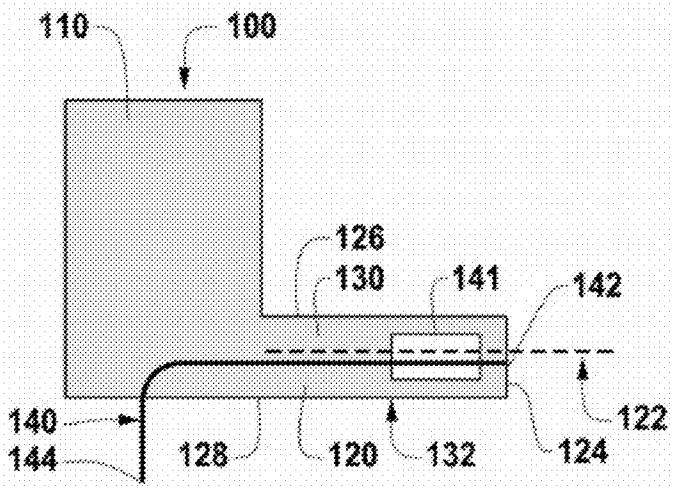

FIG. 3A shows a first step of placing the wire 140 along a portion of the protrusion 120 such that the first end 142 of the wire 140 is adjacent the distal edge 124 of the protrusion 120 and the wire 140 is disposed adjacent the first surface 130 of the protrusion 120. The wire 140 is positioned relative to the protrusion 120 such that the wire 140 extends parallel to the protrusion central axis 122. The wire 140 is held in place by an isotropic conductive PSA 141. The PSA 141 holds the wire 140 and the folded portion 134, as discussed below, in place and still allows electrical conductivity between the wire 140 and protrusion 120 through the PSA 141. However, in other implementations, the wire is held in place by any other conductive adhesive such that the wire is secured to the protrusion, and the folded portion is secured after folding, and the wire and protrusion are still in electrical communication.

FIG. 3B shows a second step of folding the distal edge 124 of the protrusion 120 over the wire 140 three times to form a folded portion 134 of the protrusion 120. Because the wire 140 extends parallel to the protrusion central axis 122, the wire 140 is folded with the protrusion 120 during the folding of the distal edge 124 of the protrusion 120. FIG. 3B shows the distal edge 124 of the protrusion 120 folded over the wire 140 three times. However, in other implementations, the distal edge 124 of the protrusion is folded over the wire one or more times.

Figure 3D:
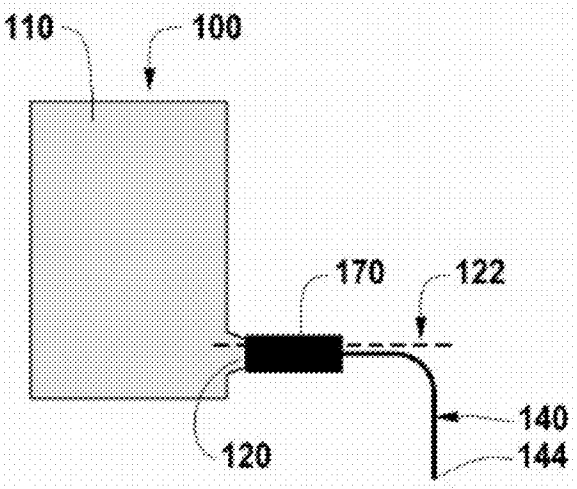
Figure 3C:
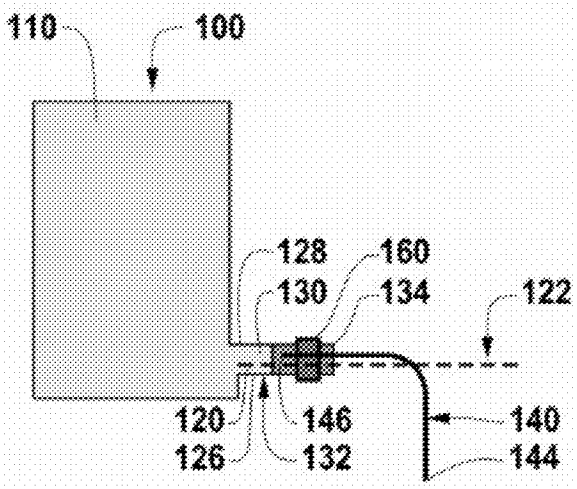

FIG. 3C shows a third step of folding the side edges 126, 128 of the protrusion 120 toward each other to decrease the width or effective diameter of the folded portion 134 and protrusion 120 as measured perpendicular to the protrusion central axis 122. FIG. 3C shows folding the side edges 126, 128 of the protrusion 120 toward each other after folding the distal edge 124 of the protrusion 120 over the wire 140. However, in other implementations, the side edges of the protrusion are folded toward each other prior to folding the distal edge of the protrusion over the wire and/or prior to placing the wire along the protrusion.

FIG. 3C also shows bending the wire 140 to form a first wire bend 146 after folding the distal edge 124 of the protrusion 120 over the wire 140. The folded portion 134 of the protrusion 120 and a portion of the wire 140 between the first wire bend 146 and the second end 144 are secured with a first securing device 160. The first securing device 160 shown in FIG. 3C is a tie (e.g., a zip tie). However, in other implementations, the first securing device can be any of the other securing devices discussed above with respect to FIG. 1E. In other implementations, the side edges of the protrusion are folded toward each other prior to securing the folded portion of the protrusion with the first securing device. FIG. 3D shows a fourth step of securing the folded portion 134 of the protrusion 120 and the first securing device 160 with a second securing device 170. The second securing device 170 shown in FIG. 3D is a heat shrink material having a shrink ratio of 4:1 such that, when the heat shrink material is heated, it decreases ("recovers") to a quarter of its size. The heat shrink material shown in FIG. 3D is a single wall heat shrink material. The heat shrink material also includes an adhesive lining on the inside of the heat shrink material. However, in other implementations, the heat shrink material has a shrink ratio of X:1, and X is 2 or greater. And, in other implementations, the heat shrink material is a double wall heat shrink material. Furthermore, in other implementations, the second securing device is any other securing device discussed above with respect to the first securing device 160 in FIG. 1E.

FIGS. 3C and 3D show the securing of the folded portion 134 of the protrusion 120 with a securing device 160, 170. However, in other implementations, the method includes securing the folded portion of the protrusion with only one securing device, or more than two securing devices.

Figure 4:
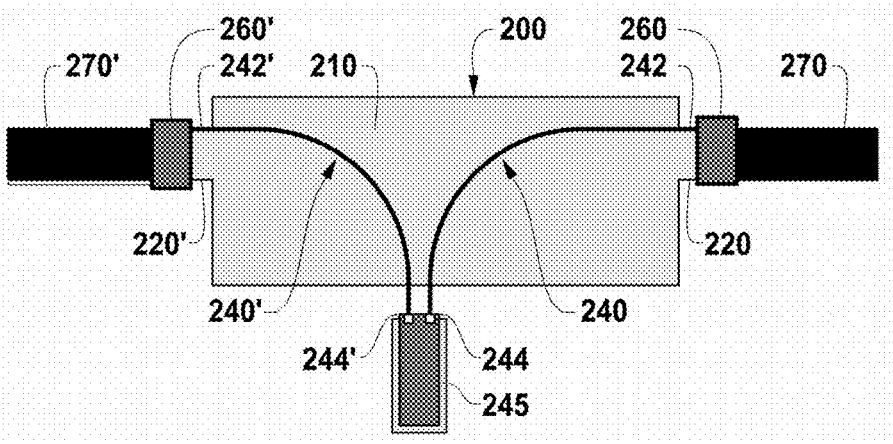
FIG. 4 is a top view of a conductive fabric having two connections to wires, in accordance with another implementation.

Each of FIGS. 1A-1G, 2A-2D, and 3A-3D show a conductive fabric 100 connected to only one wire 140. However, in other implementations, the conductive fabric has more than one protrusion and a wire is connected to each of the protrusions using any of the methods discussed above. FIG. 4 shows an implementation of a conductive fabric 200 having a first protrusion 220 and a second protrusion 220'. A first end 242 of a first wire 240 is connected to the first protrusion 220 and a first end 242' of a second wire 240' is connected to the second protrusion 220', both connections being made using the method discussed above with respect to FIGS. 1A-1G. However, in other implementations, the connections between the first wire 240 and the first protrusion 220, and the second wire 240' and the second protrusion 220', are made using any combination of the methods discussed above with respect to FIGS. 1A-1G, 2A-2D, and 3A-3D. A second end 244 of the first wire 240 and a second end 244' of the second wire 240' are coupled to a connector 245 that is structured to be connectable to a flat cable. The connector 245 can be used to electrically couple the conductive fabric 200 to any other component or device, including another conductive fabric. Although the second ends 244, 244' of the first and second wires 240, 240' are coupled to a connector 245 in FIG. 4, in other implementations, the second ends of the first and/or second wires are coupled directly to another conductive fabric. In some implementations, the second ends of the first and/or second wires are coupled directly to another electrical device or any other component for the purposes of electrical communication between the component and the conductive fabric.

Because the wire 140 is connected to the conductive fabric 100 by folding the protrusion 120 with the wire 140, the wire 140 will remain mechanically connected to the protrusion 120 when strain is applied to the conductive fabric 100 and/or the wire 140. Furthermore, because the folded portion 134 is secured by at least one securing device 160, 170, the protrusion 120 is pressed against the wire 140 within the folded portion 134, ensuring electrical contact between the protrusion 120 and the wire 140.

A number of implementations have been described. Nevertheless, it will be understood that various modifications may be made without departing from the spirit and scope of the claims. Accordingly, other implementations are within the scope of the following claims.

Certain terminology is used herein for convenience only and is not to be taken as a limitation on the present claims. In the drawings, the same reference numbers are employed for designating the same elements throughout the several figures. A number of examples are provided, nevertheless, it will be understood that various modifications can be made without departing from the spirit and scope of the disclosure herein. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. Although the terms "comprising" and "including" have been used herein to describe various implementations, the terms "consisting essentially of" and "consisting of" can be used in place of "comprising" and "including" to provide for more specific implementations and are also disclosed.

What is claimed is:

1. A method of connecting wire to conductive fabric, the method comprising:

providing a conductive fabric having a main portion and a protrusion extending from the main portion and at least partially along a protrusion central axis, the protrusion having a distal edge spaced apart from the main portion and side edges that extend between the main portion and the distal edge;

placing a wire along at least a portion of the protrusion, the wire having a first end and a second end opposite the first end;

folding the distal edge of the protrusion one or more times to form a folded portion of the protrusion such that the protrusion is folded over the wire; and after folding the distal edge, securing the folded portion of the protrusion with a securing device.

2. The method of claim 1, wherein the securing device is one of a tie, a heat shrink material, or both.

3. The method of claim 1, wherein the wire is placed along at least a portion of the protrusion such that a first end of the wire is adjacent the distal edge of the protrusion.

4. The method of claim 1, further comprising rotating the folded portion of the protrusion 90° after folding the distal edge.

5. The method of claim 1, further comprising, after placing the wire along at least a portion of the protrusion, bending the wire to form a first wire bend, the wire having a first portion that extends between the first end to the first wire bend, wherein the protrusion has a first surface and a second surface, and the first portion is disposed adjacent the first surface of the protrusion, another portion of the wire is adjacent the second surface of the protrusion, and the first portion is disposed transverse to the protrusion central axis.

6. The method of claim 5, wherein bending the wire to form the first wire bend occurs after folding the protrusion over the wire.

7. The method of claim 1, further comprising, before placing the wire along at least a portion of the protrusion, bending the wire to form a first wire bend, the wire having a first portion that extends between the first end to the first wire bend, wherein the protrusion has a first surface and a second surface, and the first portion is disposed adjacent the first surface of the protrusion, another portion of the wire is adjacent the second surface of the protrusion, and the first portion is disposed transverse to the protrusion central axis.

8. The method of claim 4, further comprising after folding the distal edge, bending the wire to form a second wire bend, the wire having a second portion that extends from the second wire bend to the second end.

9. The method of claim 1, further comprising folding the side edges of the protrusion toward each other prior to folding the distal edge of the protrusion.

10. The method of claim 1, further comprising folding the side edges of the protrusion toward each other prior to securing the folded portion of the protrusion with the securing device.

11. The method of claim 1, wherein the wire extends along an axis that is between 0° and 90° relative to the protrusion central axis prior to folding the distal edge of the protrusion, and the wire is folded with the protrusion during the folding of the distal edge of the protrusion.

12. The method of claim 11, further comprising after folding the distal edge and the wire, bending the wire to form a first wire bend, and wherein the securing device secures the folded portion and at least a portion of the wire between the first wire bend and the second end.

13. The method of claim 12, further comprising folding the side edges of the protrusion toward each other prior to securing the folded portion of the protrusion with the securing device.

14. The method of claim 13, further comprising folding the side edges of the protrusion toward each other prior to placing the wire along at least a portion of the protrusion.

15. The method of claim 1, wherein the conductive fabric comprises silver plated, knitted nylon mesh.

16. The method of claim 2, wherein the tie is a metal terminal splice, a ferrule, a zip tie, a string, tape, or an overstitch.

17. The method of claim 2, wherein the heat shrink material has a shrink ratio of X:1, wherein X is 2 or greater.

18. The method of claim 2, wherein the heat shrink material has an inside surface and includes an adhesive liner disposed on the inside surface.

19. The method of claim 2, wherein the heat shrink material is single wall heat shrink material.

20. The method of claim 2, wherein the heat shrink material is double wall heat shrink material.

* * * * *